US010962333B2

(12) United States Patent
Maji et al.

(10) Patent No.: US 10,962,333 B2
(45) Date of Patent: Mar. 30, 2021

(54) VEHICLE MOUNTED SLIDING TYPE RETRACTABLE MOBILE PROTECTIVE SHIELD

(71) Applicant: Council of Scientific and Industrial Research, New Delhi (IN)

(72) Inventors: Palash Kumar Maji, West Bengal (IN); Harish Hirani, West Bengal (IN); Avik Chatterjee, West Bengal (IN)

(73) Assignee: COUNCIL OF SCIENTIFIC AND INDUSTRIAL RESEARCH, New Delhi (IN)

( * ) Notice: Subject to any disclaimer, the term of this patent is extended or adjusted under 35 U.S.C. 154(b) by 0 days.

(21) Appl. No.: 16/827,474

(22) Filed: Mar. 23, 2020

(65) Prior Publication Data

US 2020/0393216 A1 Dec. 17, 2020

(30) Foreign Application Priority Data

Jun. 17, 2019 (IN) ..... 201911023887

(51) Int. Cl.
*F41H 5/013* (2006.01)
*F41H 5/02* (2006.01)
*F41H 5/06* (2006.01)

(52) U.S. Cl.
CPC ..... *F41H 5/013* (2013.01); *F41H 5/02* (2013.01); *F41H 5/06* (2013.01)

(58) Field of Classification Search
CPC ... F41H 5/013; F41H 5/02; F41H 5/16; F41H 13/00; B60P 3/30; A62C 27/00
See application file for complete search history.

(56) References Cited

U.S. PATENT DOCUMENTS 1,280,771 A * 10/1918 Lazowski ..... B63G 9/00
114/240 R
1,361,692 A * 12/1920 De Franc ..... B60R 21/34
293/137

(Continued)

FOREIGN PATENT DOCUMENTS

CN 108387143 A 4/2018
GB 2542128 A 8/2015

(Continued)

OTHER PUBLICATIONS

Popular Mechanics; The Kalashnikov Shield is a Monstrous Anti-Riot Truck; https://www.popularmechanics.com/military/news/a27989/kalashnikov-shchit-shield-anti-riot-vehicle/ (Year: 2017).*

(Continued)

*Primary Examiner* — Joshua E Freeman
(74) *Attorney, Agent, or Firm* — Knobbe, Martens, Olson & Bear, LLP

(57) ABSTRACT

An improved Mob Control Vehicle (MCV) may be necessary to handle riots and mobs in the streets and grounds at urban and non-urban areas. One of the important requirements of this mob control activity is barricading the entire road or ground in such a way that mob cannot harm the vehicle or ground security personnel directly. Accordingly the present invention provides a Vehicle mounted Sliding Type Retractable mobile Protective Shield, which is integrated with MCV. In general the shield is in fivefold retracted condition on rooftop of the vehicle and can be transported at sites without dismantling. During mob control activities the entire shield is brought down on the ground in vertical position ahead of the vehicle through hydraulically actuated cylinders. The side shield frames are expanded as per requirement or road or ground width, such that it can barricade the entire road or ground to protect the vehicle as well as security personnel from aggressive mob. Once the (Continued)

mob control activities are over, the entire shield is folded and retracted on the roof for transportation.

11 Claims, 5 Drawing Sheets

(56) References Cited

U.S. PATENT DOCUMENTS 3,137,205 A * 6/1964 Berge ..... B62D 55/0845 89/36.02
3,590,685 A * 7/1971 Lane ..... F41H 5/14 89/36.09
4,040,498 A * 8/1977 Johnson ..... B60K 11/04 180/68.6
4,781,101 A 11/1988 Zevulini et al.
4,844,420 A 7/1989 Oster
5,082,321 A * 1/1992 Brewer ..... B60J 1/20 296/91
5,087,092 A * 2/1992 Antopolsky ..... B60J 11/00 160/370.23
5,762,374 A * 6/1998 Grove ..... B60D 1/60 280/493
6,845,701 B2 1/2005 Drackett
7,152,517 B1 * 12/2006 Ivey ..... B63G 9/02 89/36.01
7,172,176 B1 2/2007 Eastland
7,533,600 B2 * 5/2009 Marqueling ..... F41H 5/16 89/36.09
7,841,269 B1 * 11/2010 Jacobs ..... F41H 5/013 89/36.08
9,759,011 B2 * 9/2017 Leavitt ..... E06B 9/522
2009/0120273 A1 * 5/2009 Eckdahl ..... F41H 13/00 89/36.08
2009/0241318 A1 * 10/2009 Howard ..... F41H 7/04 29/428
2011/0154981 A1 6/2011 Schneider et al.
2011/0226123 A1 9/2011 Priebe et al.

FOREIGN PATENT DOCUMENTS

KR 100823520 * 11/2007
KR 101077198 * 12/2010
KR 101601012 * 11/2015
KR 20160002217 A * 10/2016
WO WO 2018 110865 A1 6/2018

OTHER PUBLICATIONS

Daily Mail, on the World-Wide Web at: dailymail.co.uk/news/article-4832714/Russia-unveils-appropriately-named-new-anti-riot-truck.html, printed Aug. 29, 2017 in 11 pages.
Jino Motors on the World-Wide Web at: jinomotors.com/sub/sub02_02.php?idx=2, dated Apr. 15, 2020 in 2 pages.
Streit Group, on the World-Wide Web at: armored-cars.com/riot-control-front-barricade/, dated Apr. 15, 2020 in 3 pages.

* cited by examiner

VEHICLE MOUNTED SLIDING TYPE RETRACTABLE MOBILE PROTECTIVE SHIELD

FIELD OF THE INVENTION

The present invention relates to Vehicle Mounted Sliding Type Retractable Mobile Protective Shield. The main usage of this invention is to provide mobile and variable width barricade on the road or ground during riotous situation. This device is mounted on an anti riot vehicle to provide protection of the security personnel and vehicle during its movement or in static condition against ingress of aggressive mob.

BACKGROUND

Reference may be made to U.S. Pat. No. 4,781,101 A wherein a mobile hand-maneuverable security post includes a protective shield about the height of a person along with a roof and at least one porthole, which is mounted on a mobile platform comprising of two rear wheels and one front wheel. The platform further comprised of stabilizing means adapted to prevent toppling of the shield under normal use.

Reference may be made to U.S. Pat. No. 6,845,701 B2 wherein a Mobile bulletproof personnel shield consist of a frame covered with flexible ballistic shield material having resistant window and supported on a pair of large wheels. A movable gun mount is attached through an opening in the front of the flexible ballistic shield material. It allows a person to move the gunfire shield while protecting the occupant from gunfire and simultaneously operate the gun from there inside.

Reference may be made to U.S. Pat. No. 0,226,123 A1 wherein a shield apparatus includes a transparent shield portion, trim portion made of a flexible material and two flood lights. Dual handles and a detachable shoulder strap may also be provided. Video camera, thermal imaging sensors/camera and alternative lighting, including infrared, may also be provided.

Reference may be made to China Patent no. CN108387143A wherein a movable multifunctional police protective shield wall contains a shield plate, a left wing plate, a right wing plate, a peep window on the upper half of shield plate having an armor glass screen. It can be used as a movable police shield plate.

The drawbacks of the devices in U.S. Pat. No. 4,781,101A, 6,845,701 B2, 0,226,123A1 and China Patent no. CN108387143A are that one such device is suitable for only one security personnel and cannot be used as a wide barricade against the ingress of riotous mob. The movement of the device is manual and there are no means to make it compact during its transportation to the deployment site.

Reference may be made to U.S. Pat. No. 4,844,420A wherein a retractable crowd control barrier includes housing on a post member in which an elongated tape is stored by a forward wound spring-actuated spool assembly and can be extended into a position to guide pedestrian traffic and maintain an orderly assembly of people.

The drawback of the device in U.S. Pat. No. 4,844,420A is that it can neither be used to prevent the ingress of aggressive riotous mob nor to protect security personnel during riot.

Reference may be made to U.S. Pat. No. 7,172,176B1 wherein a Collapsible crowd control barrier includes a rounded top rail and a rearward projecting horizontal boss with a bore and axle. A hinged gate with a latch and catch may pivotally connect adjacent barriers to each other.

The drawback of the device in U.S. Pat. No. 7,172,176B1 is that it is a static type barrier and to be mounted on floor or road. It is to be fitted on road manually and cannot be used to drive away the mob. Its width also cannot be expanded or contracted as per the requirement of the road width for blocking.

Reference may be made to US patent no. 20110154981 A1 wherein a protective structure is provided on vehicle having an opening on an upper surface. It has multiple panels that may be locked into place or opened by an occupant for exit through the top area of the enclosure. Ballistic windows are provided on the protective structure such that an occupant can view laterally and vertically through the enclosure and overhead cover. A shield or protective plate can be mounted on one side of the enclosure.

The drawback of the device in US patent 20110154981 A1 is that it cannot be used as barricade against the ingress of aggressive riotous mob and protection of number of security personnel. It is not meant to protect the vehicle and cannot defend the security personnel when they are in riotous action outside the vehicle.

Reference may be made to WO 2018/110865 A1 wherein barricade wall mounted on rear side of vehicle includes blocking wall housing, a first blocking sliding wall and a second blocking sliding wall.

The drawback of the devices in patent no WO 2018/110865 A1, is that entire system is always vertically mounted on the rear side of vehicle and it cannot be lifted on roof while transportation. Practically barricading the aggressive mob at front side of the vehicle is preferred, as it has to intercept the mob towards front side of the vehicle. But this device cannot be mounted in front of the vehicle, because it will obstruct the vision of the driver and generate air drag during on road transportation.

Reference may be made to UK patent no. GB2542128A wherein a vehicle has at least one shield pivotally mounted at one side of the vehicle. The shield is pivotal between a deployed and an un-deployed position. At least one securing arrangement is configured to secure said shield in the deployed and un-deployed position. There is a skirting of flexible material along the bottom edge of the shield to prevent entry of any projectile below the said shield.

The drawbacks of the devices in UK Patent no GB2542128A, is that the location of shield is behind the drivers cabin, which leads to the easy access of vehicle and drivers cabin towards the front by the riotous mob. It can barricade the road or ground width equal to the maximum unfolded width of shield but not below this maximum size. The skirting below the shield being in contact with ground provides lower ground clearance of vehicle, leading to difficulties during movement over cross-country while undeployed.

Reference may be made to website www.bozena.eu wherein a giant foldable shield is mounted on Bozena riot vehicle for protection of several police personnel during riot. It contains three nos. of shielding frames; central shield frame and two numbers of sliding side shield frame, actuation of which is controlled remotely by the security personnel. During deployment shield is kept in vertical position very close to the ground and moved ahead of the vehicle to barricade against the aggressive mob. The widthwise expansion of shield through sliding movement helps in barricading any road or ground width between its minimum width of 4.5 m to 7.5 m. Security personnel can move on ground at walking speed behind this barricade along with the vehicle towards the mob. Entire shield assembly can be lifted vertically to a certain height to effectively utilize it as a gate for an instant deployment of security personnel to counter-attack the mob, as and when required. It also contains a hydraulically operated lifting platform attached to the shield exactly in front of vehicle for lifting two numbers of security personnel, who can have a longer range of view from top most point of the shield during deployment.

The drawbacks of the shield of Bozena riot is that the minimum width of the shield is 4.5 m, it means that it cannot barricade or move through the lanes below 4.5 m width. The shield can be lifted vertically upto a limited height and there is no arrangement to rest the shield at a suitable location on the vehicle in lifted condition. The minimum shield width of 4.5 m i.e. almost one and half times of heavy vehicle width, restricts the movement of vehicle in narrow lane and road by law. Even it is technically not possible to transport the vehicle from one site to another, in integrated condition, without proper resting of such a wider shield. Hence it become necessary to dismantle the shield from base vehicle and transport it in a separate trolley from one site to another site and reassembled it at the new site for deployment. This arrangement is very cumbersome, time taking and not desirable for riot like situation. The location of the lifting platform, in between vehicle and central shield, creates difficulty in access and creates hindrance in the vision of driver.

Reference may be made to website https://www.dailymail.co.uk/news/article-4832714/Russia-unveils-appropriately-named-new-anti-riot-truck.html dated 29 Aug. 2017 wherein the Kalashnikov's Shield, on similar concept of Bozena's shield, is mounted on a truck.

The drawbacks of the Kalashnikov's shield is that the shield can be lifted vertically upto a limited height and there is no arrangement to rest the shield at a suitable location on the vehicle in folded condition. The minimum shield width is much higher than the width of truck width, leading to restriction of the movement of vehicle on narrow lane and road by law. Even it is technically not possible to transport the vehicle from one site to another site, in integrated condition without proper support of such a wider shield.

Reference may be made to website http://www.jinomotors.com wherein the REX Barricade Truck manufactured by Jino motors contains the barricades in three parts, front portion and side barricades on both sides. The front part of the barricade is fixed in front of driver's cabin and side barricades are mounted pivotally on the both side of driver's cabin. While withholding, the side barricades are folded pivotally to get aligned along the side surfaces of vehicle and then slided along the sides backward, so that driver's door can be opened.

The drawbacks of the REX Barricade is that as the barricade width is expanded through rotation about the pivot, it has three fixed width equal to; width of central barricade, sum of width of central and one side barricade, sum of width of central and both side barricades. In between these any other width of road it cannot block. The barricade cannot be lifted upward, due to which the security personnel cannot come out in front of the barricade to counter-attack the mob instantly, while barricades are fully opened. As there is no upward movement of barricades, it reduces the ground clearance of the vehicle even while barricades are withheld. Since the side barricades are withheld along the side walls of the vehicle, creates difficulties in inclusion of windows and doors of the crew cabin, which are essential for swift boarding and de-boarding of security personnel from main cabin.

Reference may be made to website https://www.armoredcars.com/riot-control-front-barricade wherein the STREIT Group's truck mounted riot control-front barricade includes a vertical transparent barricade in front of the vehicle to protect vehicle as well as security personnel during riotous situation. The barricade contains three parts, one central barricade and two side barricades pivotally mounted on central part. It can provide three different width of the barricade by folding and unfolding the side barricades about the pivots. The entire barricade is withheld horizontally over the roof of the vehicle leading to normal ground clearance of the vehicle during transportation.

The drawbacks of the STREIT Group's truck mounted riot control-front barricade is that as the barricade width is rotated pivotally, it has three fixed width equal to; width of central barricade, sum of width of central and one side barricade, sum of width of central and both side barricades. In between these any other width of road it cannot barricade fully. Since the barricade covering is transparent, the mob can see the position of vehicle and security personnel from other side of the barricade, which is advantageous for mob. The width of side barricades are smaller compared to width of the vehicle, leading to very insignificant width of shield while fully unfolded. This little increase in width of barricade hardly provides any space for security personnel to move on ground along the side of the vehicle during riotous situation. If the side barricades are of larger width, it creates hindrance in opening of doors of the vehicle, while shield is retracted on the rooftop of the vehicle. There is no arrangement to rest the barricade firmly on a fixed structure over the rooftop during retractable condition, result in continuous wavering of entire barricade during on-road transportation. Moreover there is no positive locking arrangement of the barricade with rooftop structure in retractable condition, leading to chance of dislocation of shield, in case leakage or failure of hydraulic systems.

From prior art study it is found that for effective Mob Control there is a need to develop (i) A vehicle mounted foldable barricade or protective shield having variable width adjustable to the width of the street in which the vehicle is moving.

(ii) The width of the shield in compact condition should be near to vehicle width for ease of transportation and entry in narrow roads in integrated condition.

(iii) During deployment the shield location should be ahead of the driver's cabin and maximum width expansion of shield is to be significant compared to vehicle width, so that along with the vehicle several security personnel can be protected behind shield during riotous situation.

(iv) The sidewise folding mechanism should be such that any width in between the upper and lower limits of shield width can be achieved to block varieties road width and ingress of mob.

(v) The withheld position of shield on the vehicle should be such that it can be transported along with its base vehicle without dismantling.

(vi) In retractable position shield should not obstruct with vehicle door opening and vision of driver.

(vii) The shield should be rested and locked positively in retractable condition on a suitable rigid structure attached to the vehicle during transportation in integrated condition.

(viii) Location of lifting platform should be such that it can be easily accessed by ground security personnel and do not create any hindrance for driver's vision.

(ix) All hydraulic pipelines/electrical lines are to be hidden so that it does not get exposed to external projectiles and fire.

SUMMARY

The main object of the present invention is to provide Vehicle Mounted Sliding Type Retractable Mobile Protective Shield which obviates the drawbacks of the hitherto known prior art as detailed above.

Another object of the present invention is to provide hardened, fire resistant, opaque shield or barricade in order to resist ingress of attacking mob, block projectiles thrown by attacking mob, block vision of mob about status (number and position) of deployed security personal, resisting fire from petrol bombs etc. thrown by attacking mob.

Another object of the present invention is to provide vehicle mounted and collapsible shield having variable width as per the requirement of road or ground width Another object of the present invention is to provide narrow viewing ports on the opaque plates of shield frames so that only ground security personnel can see the situation of mob on other side.

Still another object of the present invention is to provide a shield, width of which in compact condition is near to vehicle width.

Still another object of the present invention is to provide a shield, which moves ahead of the driver's cabin to protect security personnel as well as vehicle during deployment during deployment.

Still another object of the present invention is to provide a shield, which can be expanded up to three times of the vehicle width.

Still another object of the present invention is to provide a shield, which can block any road or ground width ranging between the minimum and maximum width of shield.

Still another object of the present invention is to provide a shield, which can be moved up and down gradually and can also be put into any intermediate desired position whenever required.

Still another object of the present invention is to provide a shield, which can be transported along with its base vehicle without dismantling.

Still another object of the present invention is to provide a shield, which in retractable condition does not obstruct the drivers view and opening of doors and other emergency exits.

Yet another object of the present invention is to provide a shield, which can be rested and locked positively in retractable condition on a suitable rigid structure on the vehicle roof top during transportation.

Yet another object of the present invention is to provide a shield having lifting platform, which is easily accessible by ground security personnel and does not hinder the vision of driver during deployment.

An improved Mob Control Vehicle (MCV) is necessary to handle riots and mobs in the streets and urbanized areas. Two major requirements of Mob control is barricading the ingress of aggressive mob ahead of the vehicle and protecting the security deployed behind the shield. The present invention is related to fulfillment of such requirements with the help of a Vehicle mounted Sliding Type Retractable mobile Protective Shield, as follows:

i. The main components of the device are shield frames, links and lifting platform operated by several hydraulic cylinders controlled from driver's cabin.

ii. The base frames of shields are constructed with standard structural steel sections and covered entirely with hardened opaque steel sheets having fire resistant painting.

iii. Due to controlled sliding movement of side shields, any road or ground width can be blocked that are ranging between compact and expanded width of the shield. The compact minimum width of overall shield is approximately 3 m, near to the base vehicle width, and shield can be expanded up to 7.5 m, which is approximately three times of base vehicle width. The overall height of shield is in between 2.5 m to 3 m.

iv. During deployment the hardened, fire resistant shield is placed vertically ahead of the vehicle in expanded condition as per the requirement and moved along with the vehicle towards mob.

v. The vehicle and ground security personnel, who move behind the hardened and fire resistant shield, get necessary protection from projectiles, petrol bombs hurled by aggressive mob.

vi. The riotous mob cannot see the security deployment (number and position) behind the shield for any preemptive action by the security.

vii. As and when required the shield can be moved upward gradually anytime and can be held at any intermediate position, so that security personal can come out instantly and swiftly to counter attack the aggressive mob.

viii. Two numbers of hydraulically operated lifting platforms have been incorporated on both sides of central shield outside the vehicle width, such that it is easily accessible by ground security personnel and does not block the vision of driver.

ix. While mob control operation is over, the shield is fully collapsible into fivefold compact condition and retracted on a rugged structure over the rooftop of vehicle such a way that it does not intervene the view of driver and opening of vehicle doors.

x. In retractable condition the shield is provided with an additional mechanical lock to ensure zero shaking of shield structure during transportation.

xi. In retractable condition the shield can be transported along with the vehicle in integrated condition due to its compact size, proper support on rooftop structure and positive locking.

The novelty of the present invention is that it can be controlled from inside the vehicle to barricade, ahead of the vehicle, the wide ranges of road or ground width in between vehicle width and three times of vehicle width approximately, leading to mob control in different sizes of roads in urban and non-urban areas during riotous situation. At the same time it can be retracted in compact size on roof of the vehicle for safe transportation without disturbing the vision of driver or opening of vehicle doors. At both side of the vehicle the security personnel can easily access twin and foldable lift platform and it does not interfere with vision of the driver.

The fivefold shield frame structure and controlled widthwise sliding movement of side shields in a vertical plane help to achieve any barricade width in between its minimum compact size to maximum expanded size. Two numbers of long banana boom links, operated by four numbers of hydraulic cylinders, holds the shields in vertical position as well as lift it on the roof in compete folded condition such that it does not interfere with vehicle door opening as well as driver's sight. The rugged rooftop support structure and mechanical locking system holds the entire shield assembly firmly with vehicle, which helps in safe transportation of present invention in integrated condition without dismantling. The folding and twin lift platforms are mounted on both sides of the central shield frame and outside the vehicle width at a suitable height from the ground, leading to its easy access by ground security personnel from both side of the vehicle.

The present invention is illustrated in FIGS. 1 to 5 of the drawing(s) accompanying this specification. In the drawings like reference numbers/letters indicate corresponding parts in the various figures.

DETAILED DESCRIPTION

Figure 1:
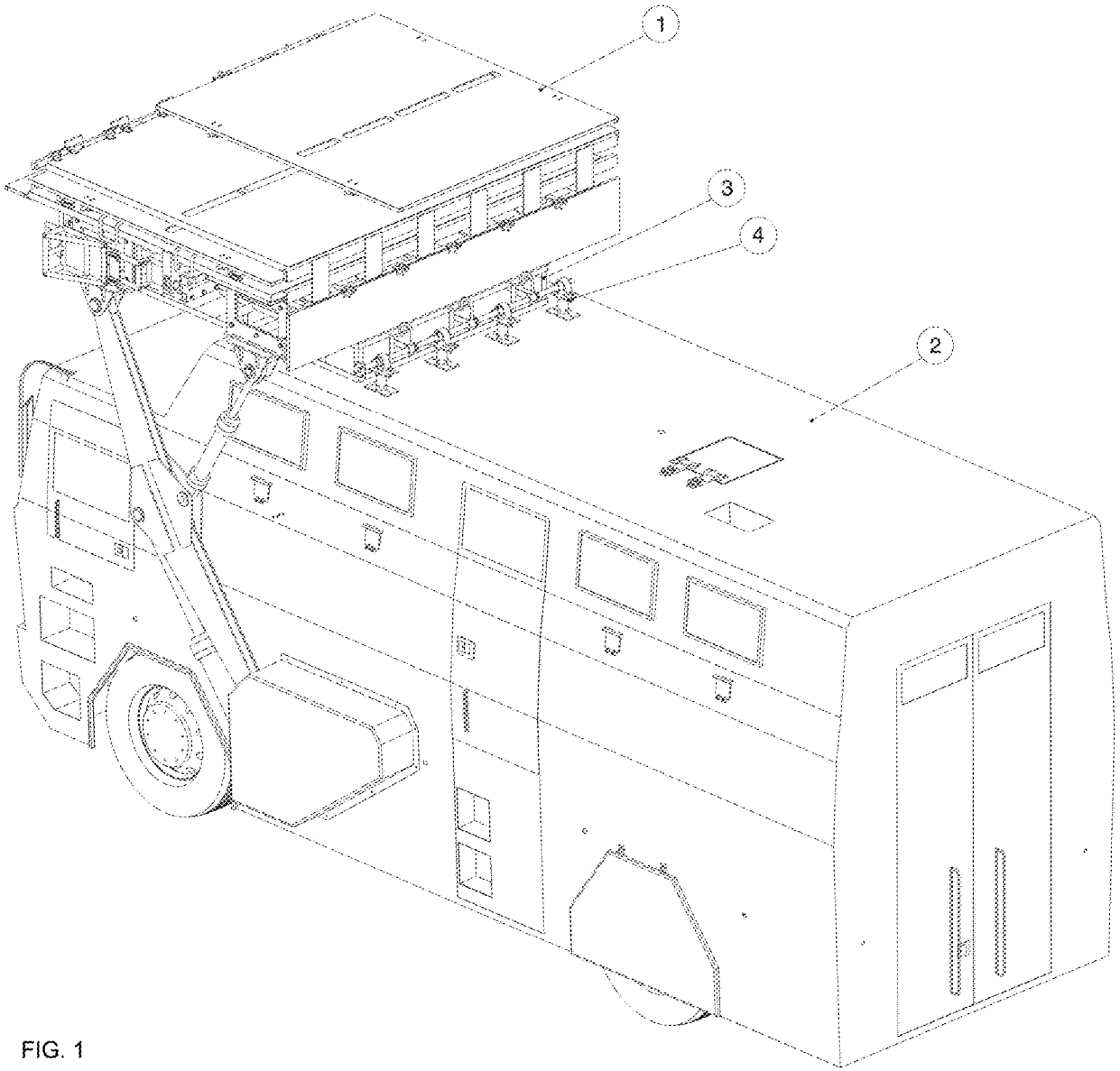
FIG. 1: 3D CAD model of Mob control vehicle while shield is retracted on roof

FIG. 1 represents the 3D CAD model of an entire Mob control vehicle, while the present invention i.e. Vehicle Mounted Sliding Type Retractable Mobile Protective Shield [1] is in compact condition on roof of base vehicle [2]. A rugged rooftop structure [3], associated part of present invention, on the vehicle provides the support to rest the protective shield in retracted condition during transport. The mechanical lock system [4], another associated part of present invention, is included on the roof to hold the shield structure positively with the said structure.

Figure 2:
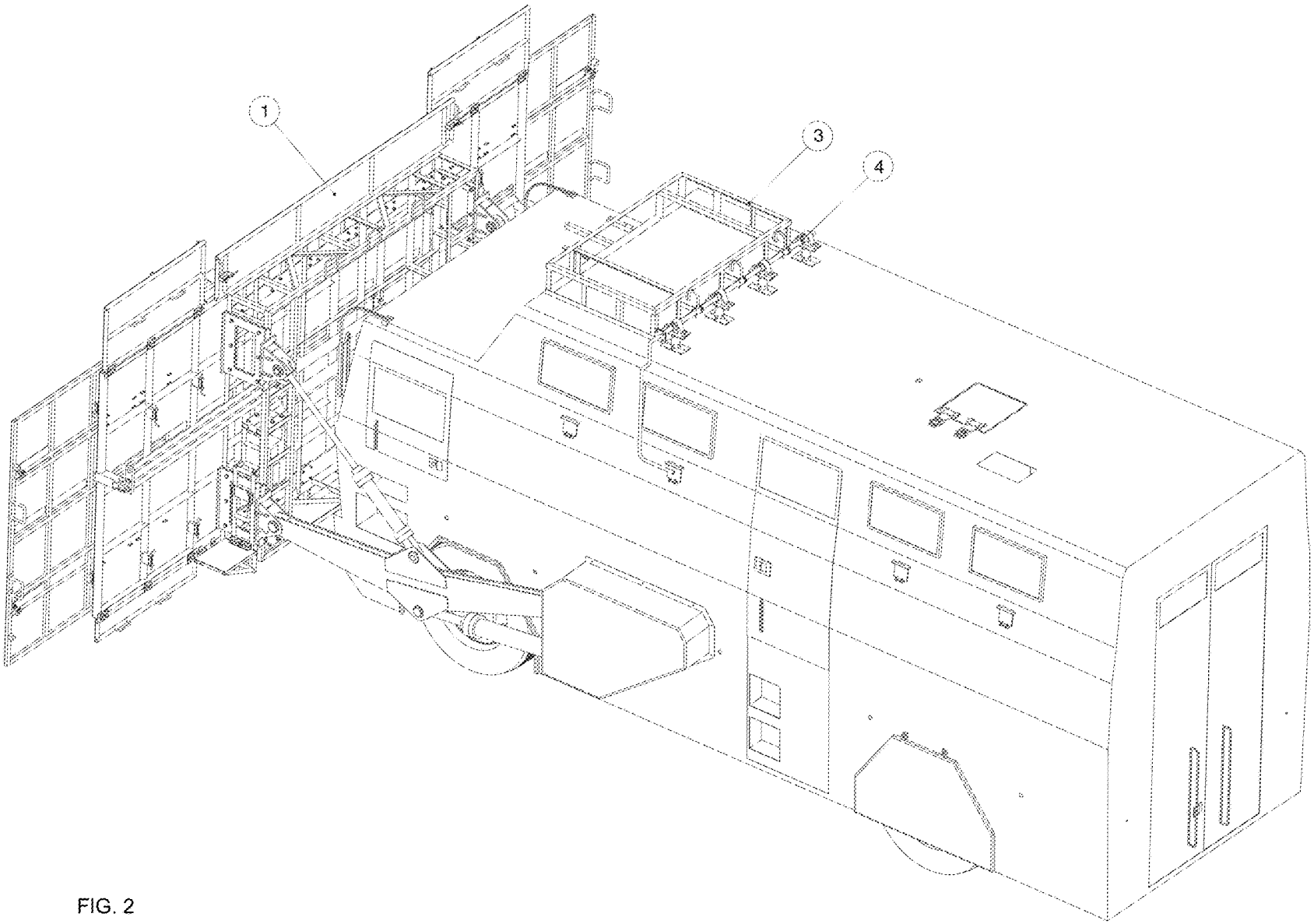
FIG. 2: 3D CAD model of the entire Mob control vehicle during deployment

FIG. 2 represents the 3D CAD model of the entire Mob control vehicle configured as during deployment of vehicle mounted Sliding Type Retractable mobile Protective Shield [1].

Figure 3:
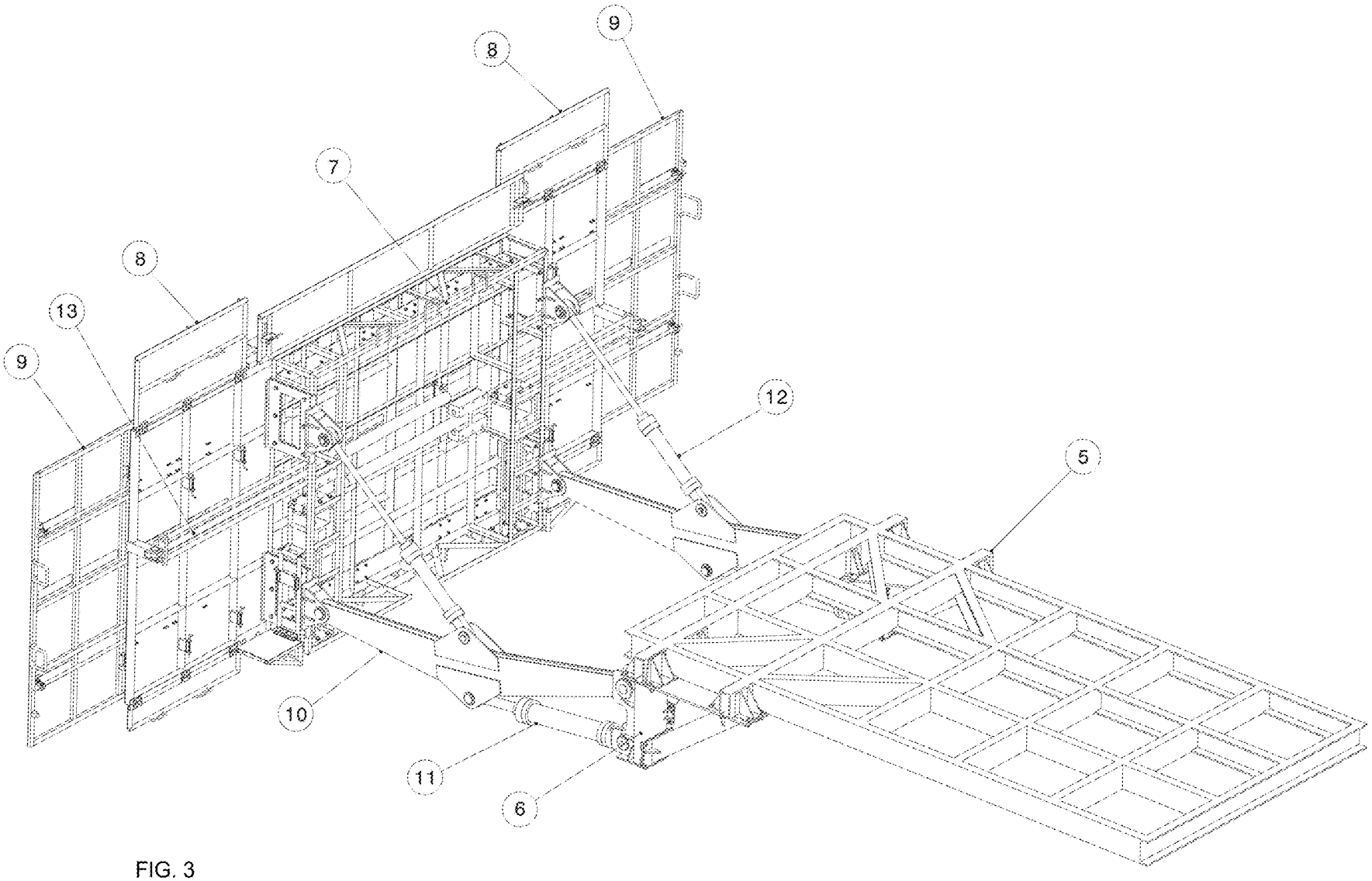
FIG. 3: 3D CAD model of the vehicle mounted Sliding Type Retractable Mobile Protective Shield attached to Chassis Platform

FIG. 3 represents the 3D CAD model of the vehicle mounted Sliding Type Retractable Mobile Protective Shield attached to Chassis platform [5] of the main vehicle through two numbers of suitable brackets [6] on both side. The Shield consists of one Central shield frame [7], two numbers of large side shield frames [8] and two numbers of small side shield frames [9] covered with opaque steel plates having viewing slots on it. Two numbers of banana boom link [10], two numbers of bottom hydraulic cylinder [11] and two numbers of top hydraulic cylinders [12] provides necessary up and down movement to the said shield frames. Large side shield frames undergoes sliding movement widthwise by two numbers of sliding hydraulic cylinder [13] for expansion and contraction of the shield width. Similarly the small side shield frames can be expanded as per requirement.

Figure 4:
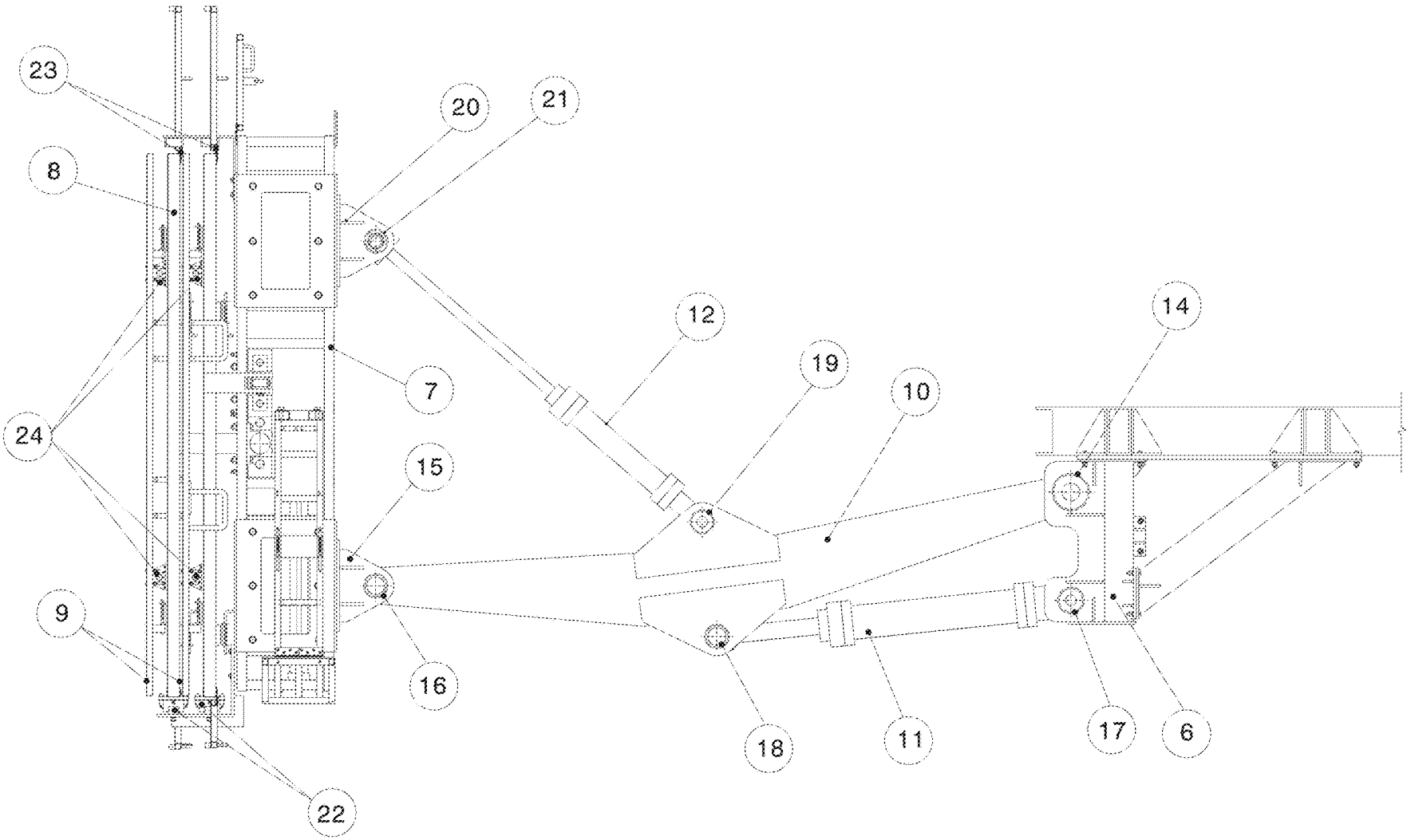
FIG. 4: 2D drawing of side view of the vehicle mounted Sliding Type Retractable Mobile Protective Shield

FIG. 4 represents the 2D drawing of Left Hand Side view of the vehicle mounted Sliding Type Retractable Mobile Protective Shield. One end of banana boom link [10] is connected with brackets [6] of chassis platform [5] through pin joints [14] and other end is connected with lower brackets [15] of Central shield frame [7] through pin joints [16]. One end of bottom hydraulic cylinder [11] is connected with brackets [6] of chassis platform through pin joints [17] and other end is connected with banana boom link [10] through pin joints [18]. Similarly ends of top hydraulic cylinders [12] is connected through pin joints [19] with banana boom link [10] and pin joints [20] on upper brackets [21] of Central shield frame [7]. The up and down movement of the entire protective shield takes place with expansion and contraction of bottom and top hydraulic cylinders about the pin joints. Widthwise expansion and contraction of large side shield frames [8] are guided by two numbers of Linear Motion guide rails [22] at bottom and bearing guided channels [23] at top. Similarly widthwise sliding motion of small side shield frames [9] take place through four numbers of Linear Motion Bush guides [24].

Figure 5:
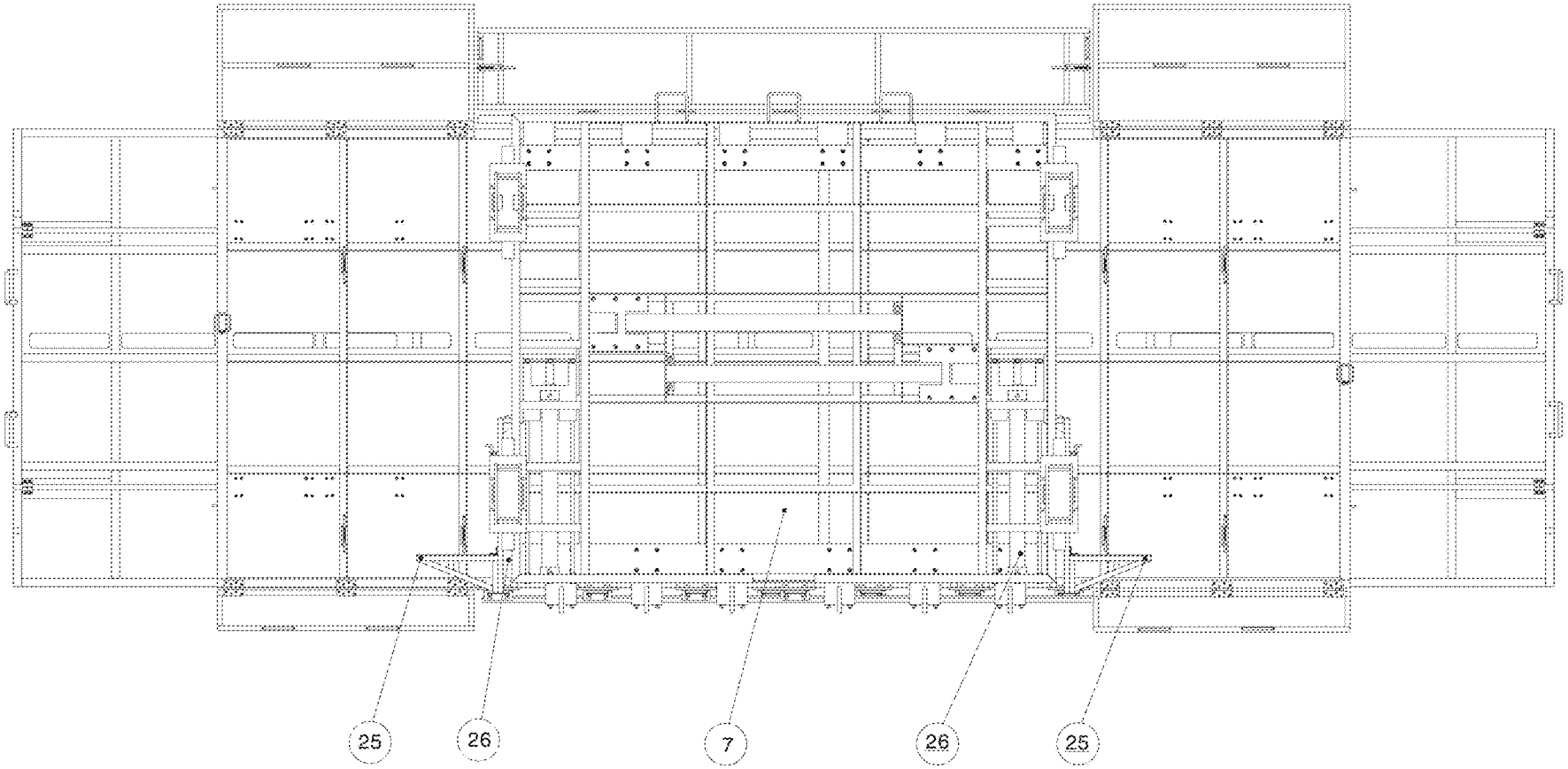
FIG. 5: 2D drawing of back side view of the vehicle mounted Sliding Type Retractable Mobile Protective Shield

FIG. 5 represents the 2D drawing of back side view of the vehicle mounted Sliding Type Retractable Mobile Protective Shield, while it is fully expanded for deployment. Two numbers of lift platforms [25] are mounted on their respective Lift Cylinders [26] on both sides of Central shield frame [7]. The Expansion and compression of lift cylinders helps in vertical up down movement of each lift platforms, on which security personnel stands for getting long distance views from top of the Shields.

Accordingly the present invention provides Vehicle mounted Sliding Type Retractable mobile Protective Shield which comprises Central shield frame [7], two numbers of hardened metal fire resistant large side shield frames [8], two numbers of hardened metal fire resistant small side shield frames [9], two numbers of banana boom links [10], two numbers of bottom hydraulic cylinder [11], two numbers of top hydraulic cylinders [12], two numbers of sliding hydraulic cylinder [13], two numbers of Linear Motion guide rails [22], two numbers of bearing guided channels [23] four numbers of Linear Motion Bush guides [24] and two numbers of lift platforms [25] on their respective Lift Cylinders [26] on both sides of Central shield frame [7] to provide a fivefold protective opaque barricade.

In an embodiment of the present invention the entire structure of present invention is always integrated with base vehicle [2] for necessary on road movement during deployment as well as transportation.

In an embodiment of the present invention banana boom links [10], bottom hydraulic cylinders [11] and top hydraulic cylinders [12] holds the hardened and fire resistant shield ahead of the vehicle in vertical position during deployment to protect vehicle and security personnel from projectiles, petrol bombs hurled by aggressive mob.

In an embodiment of the present invention banana boom links [10], bottom hydraulic cylinders [11] and top hydraulic cylinders [12] retract the entire shield frames on the rooftop of vehicle in horizontal and compact position during transportation.

In an embodiment of the present invention banana boom links [10], bottom hydraulic cylinders [11] and top hydraulic cylinders [12] provide controlled gradual up and down movement of shield frames during deployment for instant release of the security personnel in front of the shield to counter-attack the mob, as per requirement.

In an embodiment of the present invention the shield frames rest firmly on the rooftop structure [3] in complete compact condition and the mechanical lock system [4] hold it positively to arrest any kind of vibration of entire device during transportation in integrated condition with base vehicle. In this position all shield frames are retracted in such a way that those are not projected below the roof level.

In an embodiment of the present invention during deployment the sliding hydraulic cylinders [13] expand and collapse widthwise the large side shield frames [8] on both sides in respect to the Central shield frame [7] through sliding motion, via Linear Motion guide rails [22] and bearing guided channels [23].

In an embodiment of the present invention during deployment the small side shield frames [9] can be expanded and collapsed widthwise on both sides in respect to the large side shield frames [8] through sliding motion via Linear Motion Bush guides [24].

In an embodiment of the present invention the combination of sliding motion of all side shield frames can achieve any intermediate position between maximum and minimum width of entire shield, leading to barricading any road or ground width in that range.

In an embodiment of the present invention narrow viewing ports on the opaque plates of shield frames [7,8,9] ensure that only ground security personnel can see the situation of mob on other side but mob cannot see the position of security personnel.

In still another embodiment of the present invention on both sides of Central shield frame [7] there are two numbers of lift cylinders [26], on which two separate folding lift platforms [25] are mounted for up and down movement of the security personnel.

The present invention i.e. Vehicle mounted Sliding Type Retractable mobile Protective Shield mainly contains five numbers of shield frames [7,8,9] fabricated with structural steel sections and covered with hardened fire resistant coated metallic sheets to make it opaque and also prevent projectiles/petrol bombs hurled by riotous mob. The large sliding shield frames [8] are mounted on the central shield frame [7] with the help of two sets of Linear Motion guide rails [22] and bearing guided channels [23]. The small sliding shield frames [8] are mounted on the large sliding shield frames [8] with the help of four sets of Linear Motion Bush guides [24]. There are number of narrow viewing ports the shields for security personnel. The central shield frame [7] is mounted on two numbers of brackets [6] of chassis platform [5] of base vehicle [2] with the help of two numbers of banana boom links [10] and brackets [15] of central shield frame [7] via pin joints [14 & 16]. One bottom hydraulic cylinder [11] is connected between each bracket [6] of chassis platform and banana boom link [10] via pin joints [17 &18]. Similarly one top hydraulic cylinder [12] is connected between each banana boom link [10] and upper bracket [20] of central shield frame via pin joint [19 & 21]. Two numbers of lift platforms [25] are attached to respective Lift Cylinders [26], which are mounted on both side of Central shield frame [7]. The lift platforms [25] are normally kept in folded and locked condition vertically attached to the sides of central shield frame [7]. When required the lift platforms [25] are unlocked and get unfolded sidewise horizontally.

The novelty of the invention is that it can be controlled from inside the vehicle to barricade the varieties of road or ground width, ahead of the driver's cabin, ranging from base vehicle width upto three times of the vehicle width approximately. The wide shield can be folded near to the vehicle width and withheld on the vehicle roof for transportation in integrated condition without intervening driver's vision and opening of vehicle doors. The foldable and twin lift platforms are easily accessible by ground security personal from both side of the vehicle and its up and down movement does not interfere with vision of driver.

The wide range of continuous width expansion and contraction along a plane is possible due to sliding motion of fivefold shielding system. Two numbers of hydraulically actuated long banana boom help in holding the shield firmly in vertical position ahead of the vehicle. The shield can be folded near to the vehicle width through sliding motion and can be retracted on rooftop structure support with the help of said hydraulically actuated banana boom. Further the shield structure can be positively locked to the vehicle rooftop structure using a mechanical locking system for ease of its transportation without dismantling. As all shield frames lies completely on the rooftop during retracted condition, it does not interfere with driver's vision of view or opening of doors. The foldable and twin lift platforms are mounted on both sides of central shield frame and away from the vehicle sides at an easily accessible height for the ground security personnel.

The Vehicle mounted Sliding Type Retractable mobile Protective Shield is mainly used for barricading the mob, check ingress of attacking riotous mob and protects the vehicle along with security personnel taking shelter behind the shield during riotous situations While transporting from one site to another site the shield is in retractable position on the roof in horizontal lying position. Deployment of the device is controlled from inside the vehicle using joysticks. Initially the mechanical lock on the roof is unlocked manually with the help of a lever which is located outside the vehicle and accessible from cabin through a small port on one side of the vehicle. Holding Joystick-1 towards front the entire shield comes down gradually and held vertically ahead of the driver's cabin. Further holding the joystick-1 the larger shield frames expand widthwise gradually by sliding motion upto double of the vehicle width. The width can be further expanded upto three times of vehicle width by unlocking and outward sliding movement of smaller side shield manually. However the side shield positions can be held widthwise in between at any position, to block the road or ground width. Now the shield will work as a mobile barricade and ground security personnel moves behind the barricade at vehicle's side. The mob being at other side of the barricade, it protects the vehicle and ground security personnel. The lift platforms are unfolded and one security person stands on each lift platform. Another Joystick-2 is operated for moving the lift platform upward along with the security personnel and reverse operation of same joystick provides downward movement of the lift platform. The security personnel get down from the lift platforms and those are folded and locked sidewise with the central frame. The small side shields are unfolded manually and locked with large side shields. Now holding the joystick-1 in backward position the large side shields collapsed towards central shield frame. Further holding the joystick-1 in same position, the entire shield goes up and rests on the rooftop structure and gets locked with mechanical locking system. Now the vehicle is ready to transport along with the shield in integrated condition.

Advantages of the present invention are:

1. The device is vehicle mounted and can be moved ahead of the vehicle during deployment for protection of vehicle as well as ground security personnel behind it.

2. The shield width is expandable ranging from vehicle width to 3 times of vehicle width and width can be held at any dimension in between this range. It helps in barricading the roads or ground of different widths and protection of several security personnel behind it.

3. As the shield is opaque, the mob cannot see the number and position of security personnel. But Security personnel can see the situation of mob at other side of the barricade through viewing port on it.

4. The vehicle and ground security personnel, who move behind the hardened and fire resistant shield, get necessary protection from projectiles, petrol bombs hurled by aggressive mob.

5. During deployment, the entire shield can be lifted up gradually, whenever required to release the ground security personnel instantly to counter attack the mob.

6. The entire shield can be retracted in compact condition on the vehicle rooftop support and locked positively; which helps in transportation of device along with base vehicle in integrated condition without dismantling.

7. While transporting the shield does not interfere with the vision of driver or opening of the doors of vehicle.

8. The Lift platform is easily accessible by ground security personnel and does not hinder the vision of driver during deployment.

What is claimed is:

1. A vehicle mounted sliding type retractable mobile protective shield comprising: a central shield frame, two hardened metal fire resistant large side shield frames, two hardened metal fire resistant small side shield frames, two banana boom links, two bottom hydraulic cylinder, two top hydraulic cylinders, two sliding hydraulic cylinder, two linear motion guide rails, two bearing guided channels, four linear motion bush guides, and two lift platforms on their respective lift cylinders on both sides of said central shield frame to provide a fivefold protective opaque barricade.

2. The vehicle mounted sliding type retractable mobile protective shield of claim 1, wherein the entire structure is integrated with a base vehicle for necessary on road movement during deployment as well as transportation.

3. The vehicle mounted sliding type retractable mobile protective shield of claim 1, wherein said banana boom links, bottom hydraulic cylinders and top hydraulic cylinders hold the hardened and fire resistant shields ahead of the vehicle in a vertical position during deployment to protect the vehicle and security personnel.

4. The vehicle mounted sliding type retractable mobile protective shield of claim 1, wherein said banana boom links, bottom hydraulic cylinders and top hydraulic cylinders retract the entire shield frames onto a rooftop of the vehicle in a horizontal and compact position during transportation.

5. The vehicle mounted sliding type retractable mobile protective shield of claim 1, wherein said banana boom links, bottom hydraulic cylinders and top hydraulic cylinders provide controlled gradual up and down movement of said shield frames during deployment for instant release of security personnel in front of the shield.

6. The vehicle mounted sliding type retractable mobile protective shield of claim 1, wherein the shield frames rest firmly on a rooftop structure in a complete compact condition and a mechanical lock system hold said shield frames positively to arrest any kind of vibration during transportation such that all shield frames are retracted above the rooftop.

7. The vehicle mounted sliding type retractable mobile protective shield of claim 1, wherein during deployment the sliding hydraulic cylinders expand and collapse, widthwise, the large side shield frames on both sides in respect to the central shield frame through sliding motion, via said linear motion guide rails and bearing guided channels.

8. The vehicle mounted sliding type retractable mobile protective shield of claim 1, wherein during deployment the small side shield frames can be expanded and collapsed widthwise on both sides in respect to the large side shield frames through sliding motion via said linear motion bush guides.

9. The vehicle mounted sliding type retractable mobile protective shield of claim 1, wherein, the combination of sliding motion of all side shield frames can achieve any intermediate position between a maximum and minimum width of the entire shield, leading to barricading any road or ground width in that range.

10. The vehicle mounted sliding type retractable mobile protective shield of claim 1, wherein narrow viewing ports on the opaque plates of shield frames so that only ground security personnel can see the situation of mob on other side but mob cannot see the position of security personnel.

11. The vehicle mounted sliding type retractable mobile protective shield of claim 1, wherein on both sides of central shield frame there are two lift cylinders, on which two separate lift platforms are mounted for up and down movement of the security personnel.

* * * * *